US005992657A

United States Patent [19]

Friedman

[11] Patent Number: 5,992,657

[45] Date of Patent: Nov. 30, 1999

[54] SAFETY CLOSURE HAVING TAMPER-INDICATING MEANS

[75] Inventor: Alberto Friedman, Alpharetta, Ga.

[73] Assignee: Rexam Plastics Inc., Evansville, Ind.

[21] Appl. No.: 09/085,772

[22] Filed: May 28, 1998

[51] Int. Cl.[6] ..... B65D 50/00; B65D 50/08

[52] U.S. Cl. ..... 215/209; 215/216; 215/224; 215/252

[58] Field of Search ..... 215/216–219, 215/221, 252, 209, 224

[56] References Cited

U.S. PATENT DOCUMENTS

| | | | |
|---|---|---|---|
| 3,233,769 | 2/1966 | Jessop | 215/216 |
| 3,445,022 | 5/1969 | Cilluffo | 215/216 |
| 3,967,745 | 7/1976 | Julian . | |
| 4,103,797 | 8/1978 | Morris | 215/209 |
| 4,144,983 | 3/1979 | Pauls et al. | 215/216 |
| 4,149,646 | 4/1979 | Julian | 215/216 |
| 4,341,318 | 7/1982 | Smalley . | |
| 4,573,599 | 3/1986 | Fillmore . | |
| 4,619,370 | 10/1986 | Agbay et al. . | |
| 5,040,692 | 8/1991 | Julian . | |
| 5,165,559 | 11/1992 | Kuz | 215/216 |
| 5,314,085 | 5/1994 | Collado Bonet . | |
| 5,398,829 | 3/1995 | Stubbs . | |
| 5,460,281 | 10/1995 | Rapchak et al. | 215/216 |
| 5,564,580 | 10/1996 | Hamilton et al. | 215/209 |

*Primary Examiner*—Allan N. Shoap
*Assistant Examiner*—Joe Merek
*Attorney, Agent, or Firm*—Middleton & Reutlinger; John F. Salazar; Charles G. Lamb

[57] ABSTRACT

A safety closure is provided for threadingly engaging a neck portion of a container. The safety closure includes a cap portion and a tamper-indicating band connected to a lower end of a peripheral side wall of the cap portion by a plurality of frangible bridge segments. A cap lug projects downwardly from an outer surface of the cap portion and is sized to engage a band lug projecting upwardly from an outer surface of the tamper-indicating band. At least one bead segment projects inwardly from an inner surface of the tamper-indicating band and is sized to engage a continuous bead projecting outwardly from an outer surface of the container neck portion to prevent removal of the tamper-indicating band therefrom upon a first application thereto. Removal of the cap portion from the container neck portion a first time breaks the plurality of frangible bridge segments, thereby detaching the cap portion from the tamper-indicating band and permitting removal of the cap portion from the container neck portion, while retaining the tamper-indicating band on the container neck portion for subsequent use.

34 Claims, 16 Drawing Sheets

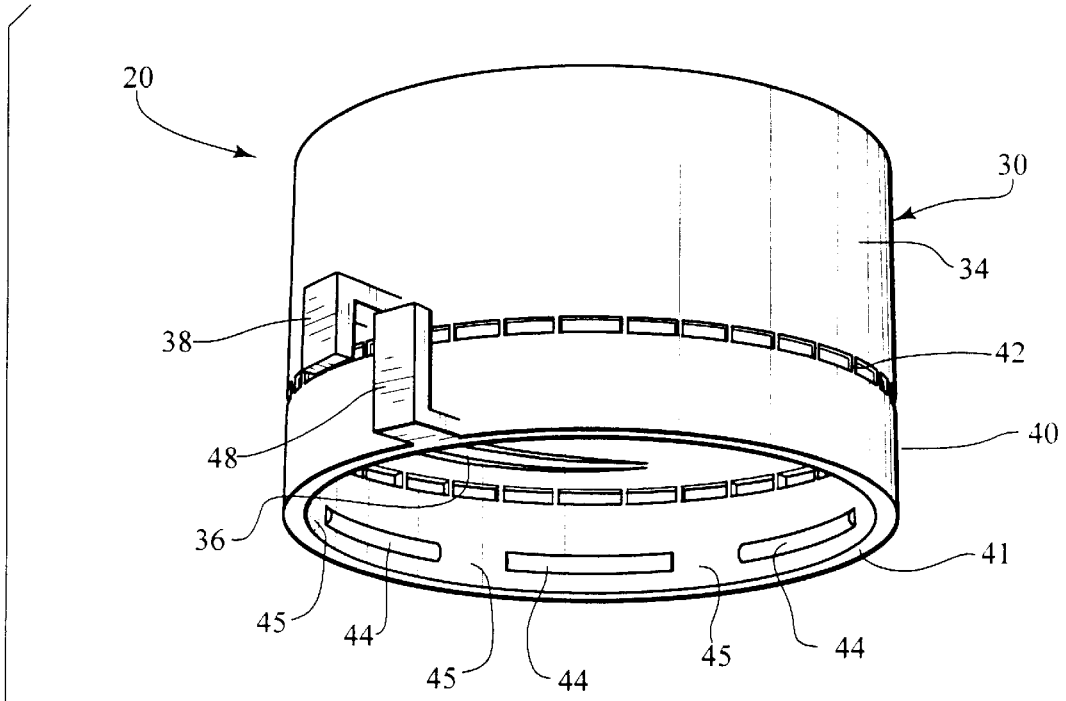
FIG. 1
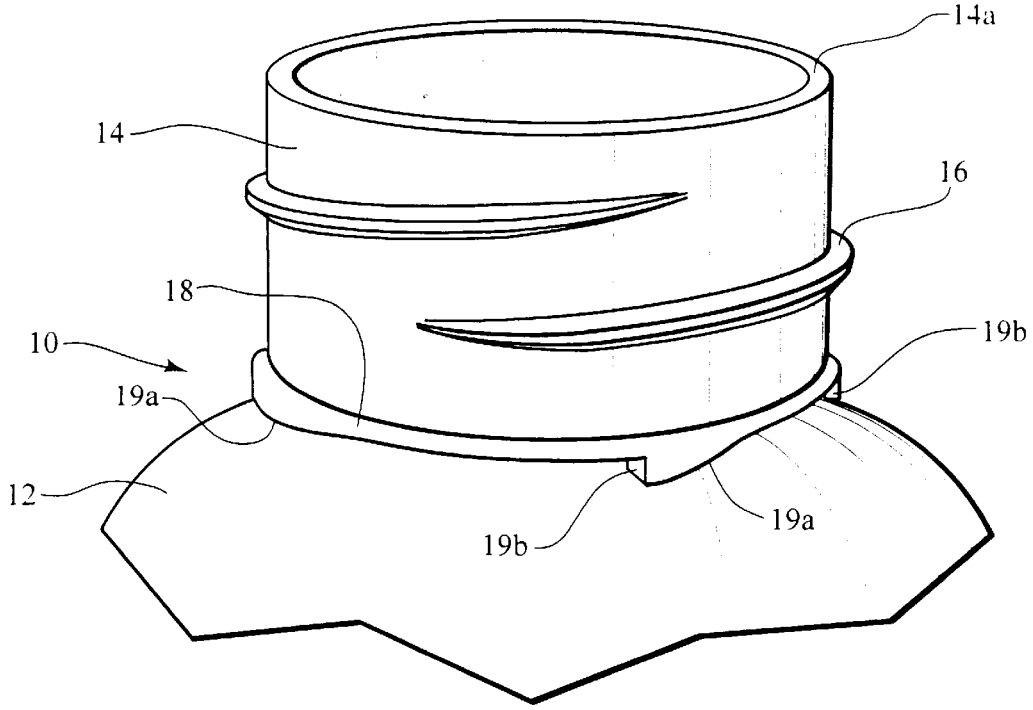

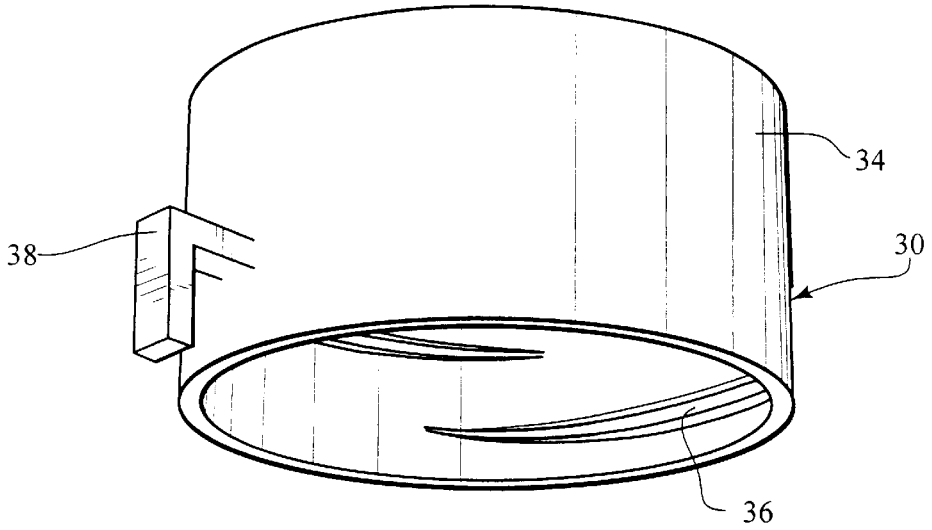
FIG. 6
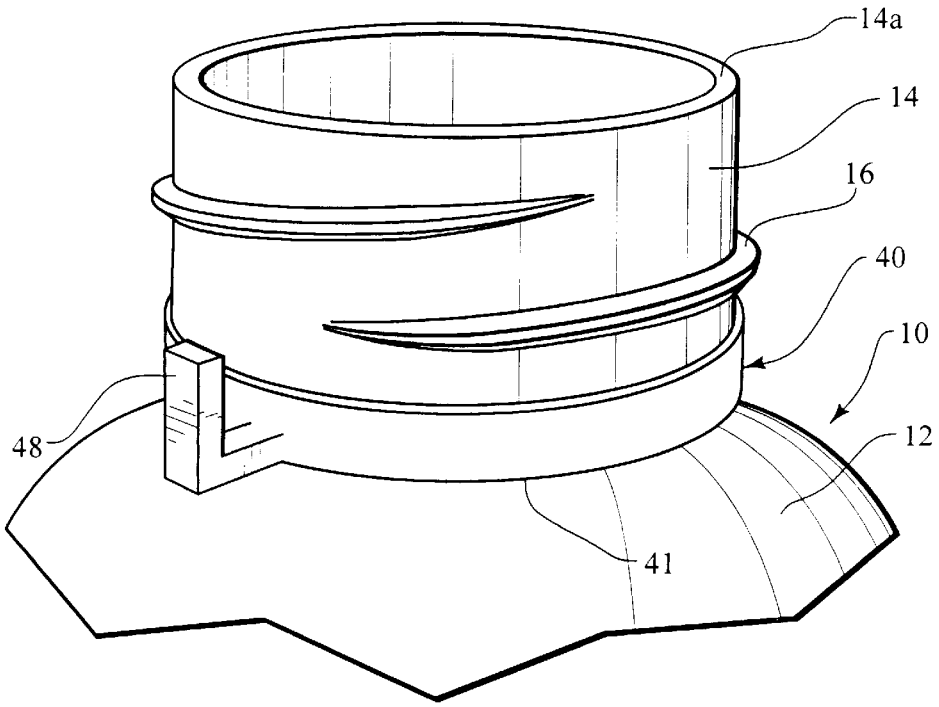

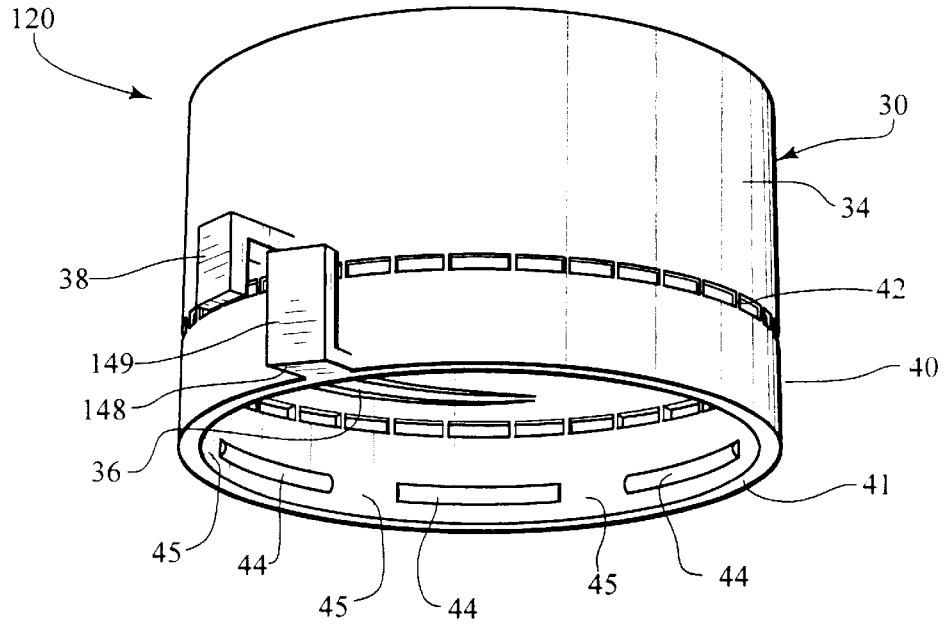
FIG. 7
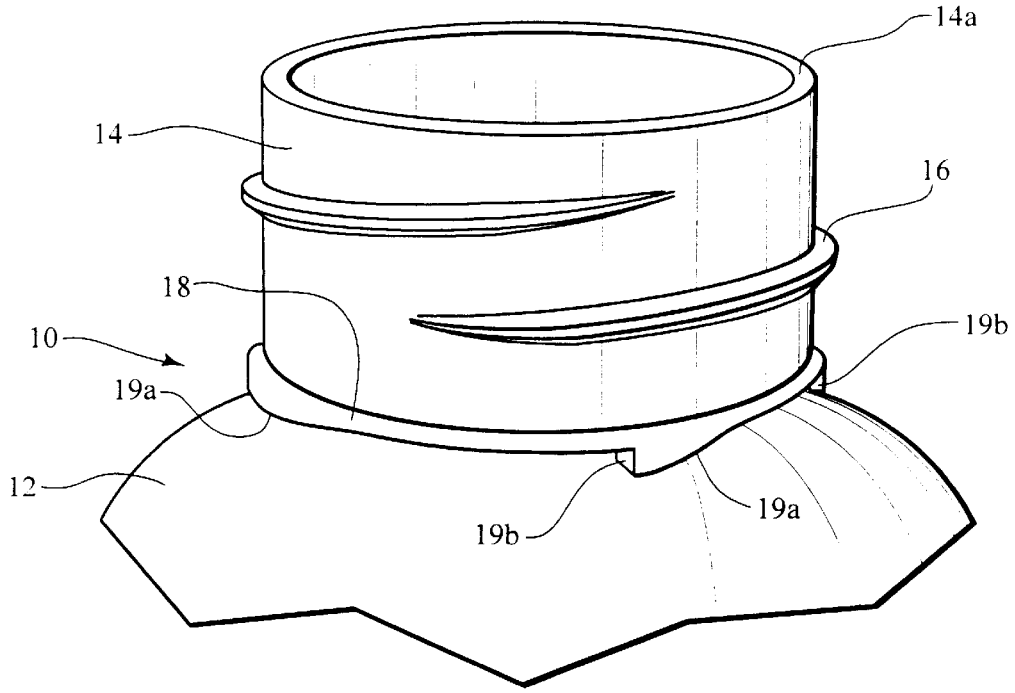

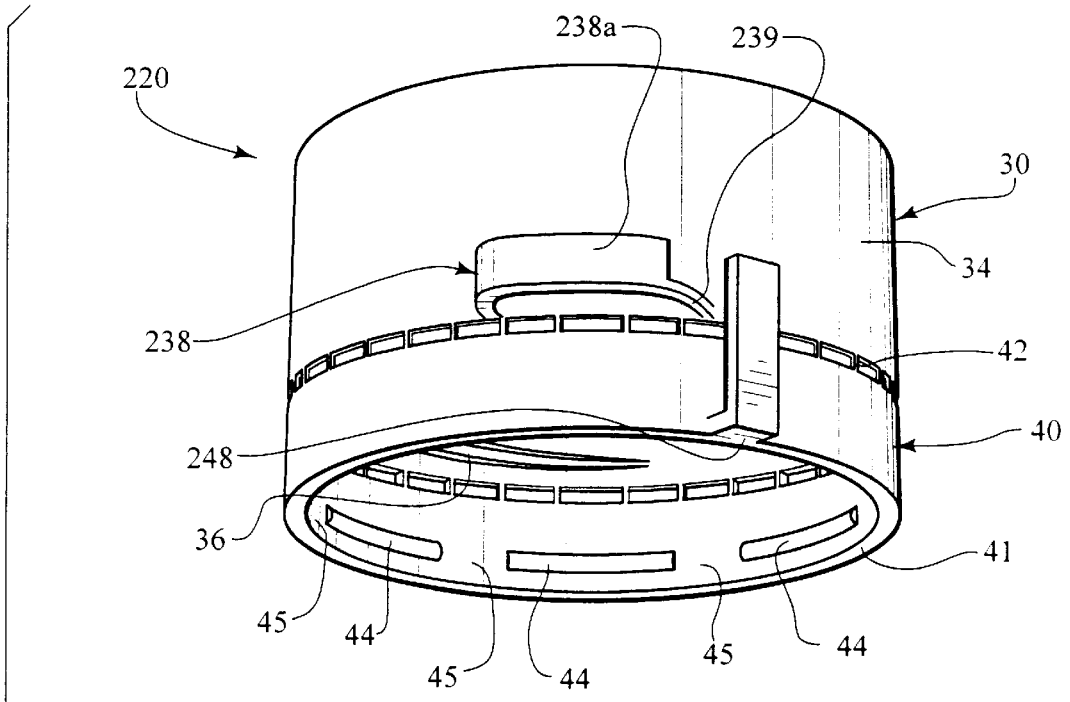
FIG. 8
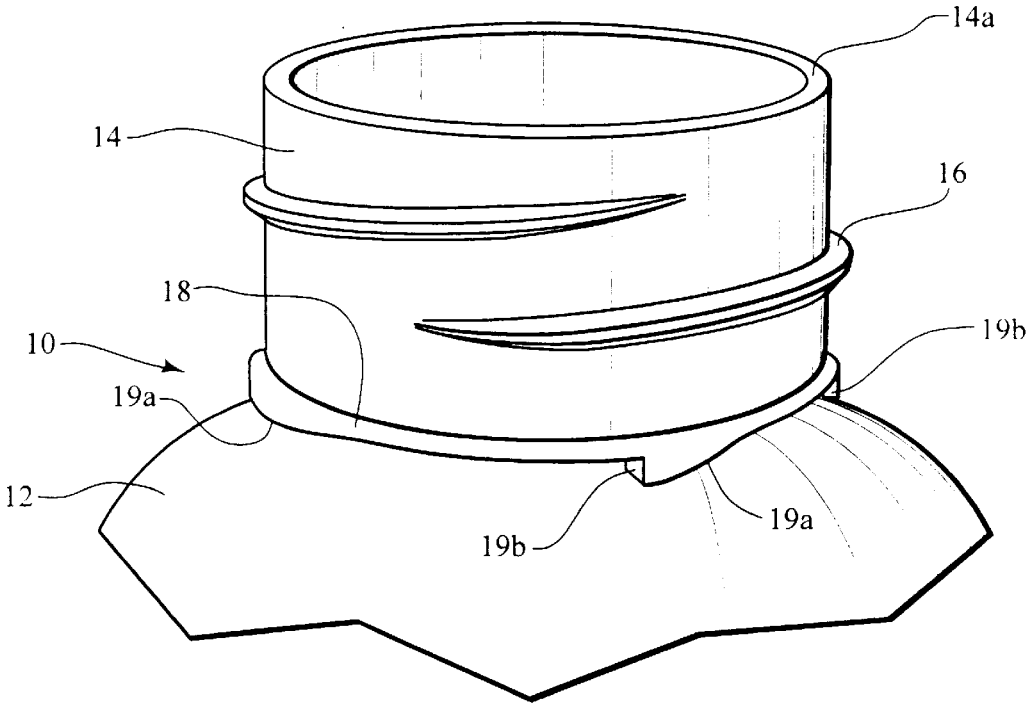

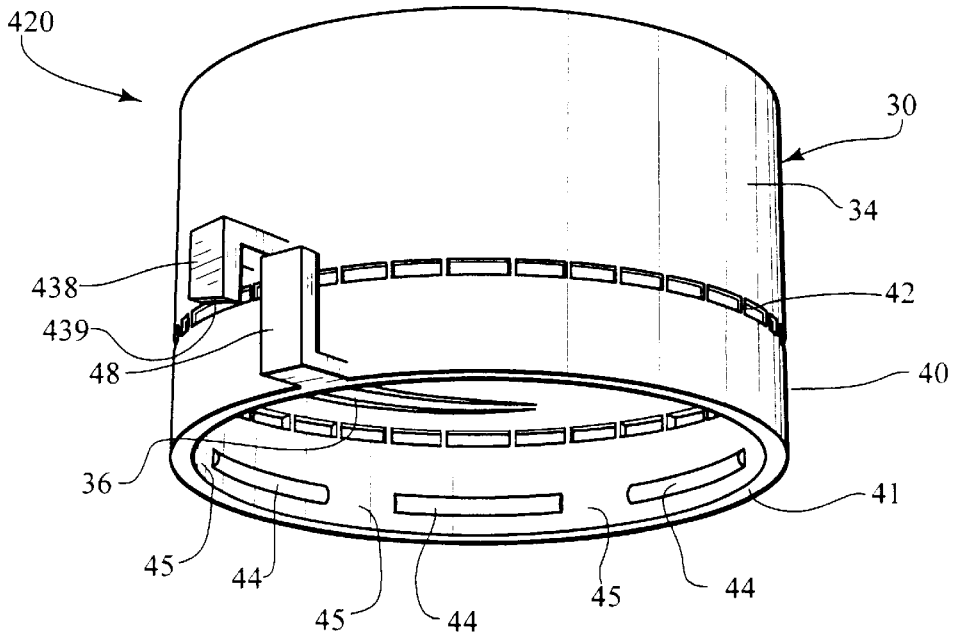
FIG. 13
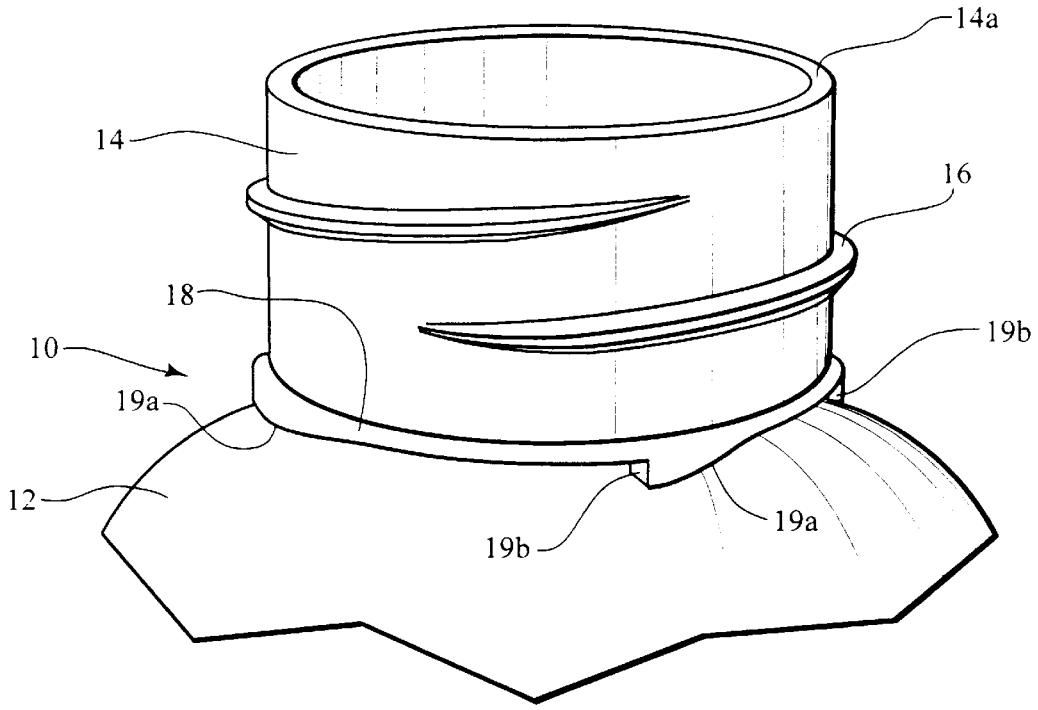

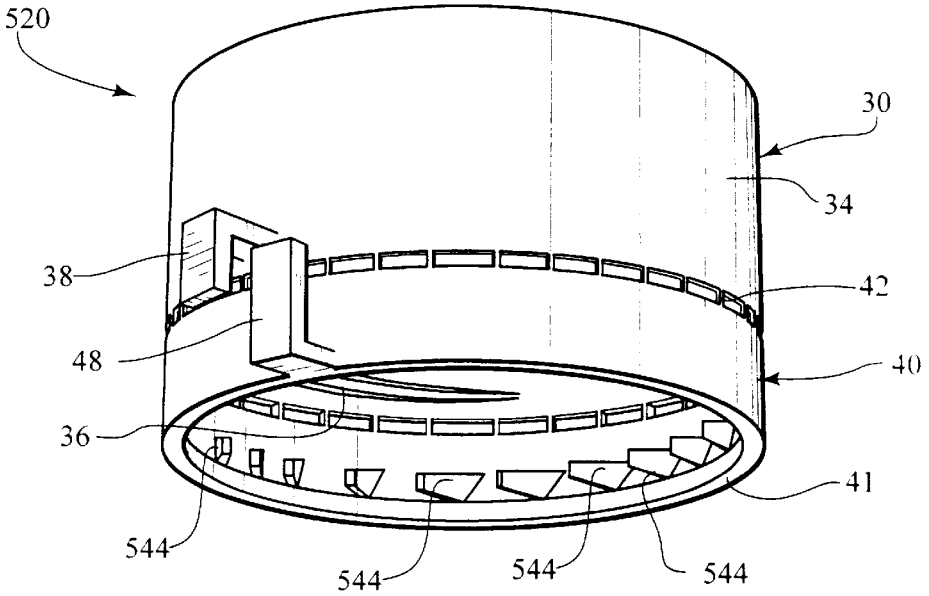
FIG. 14
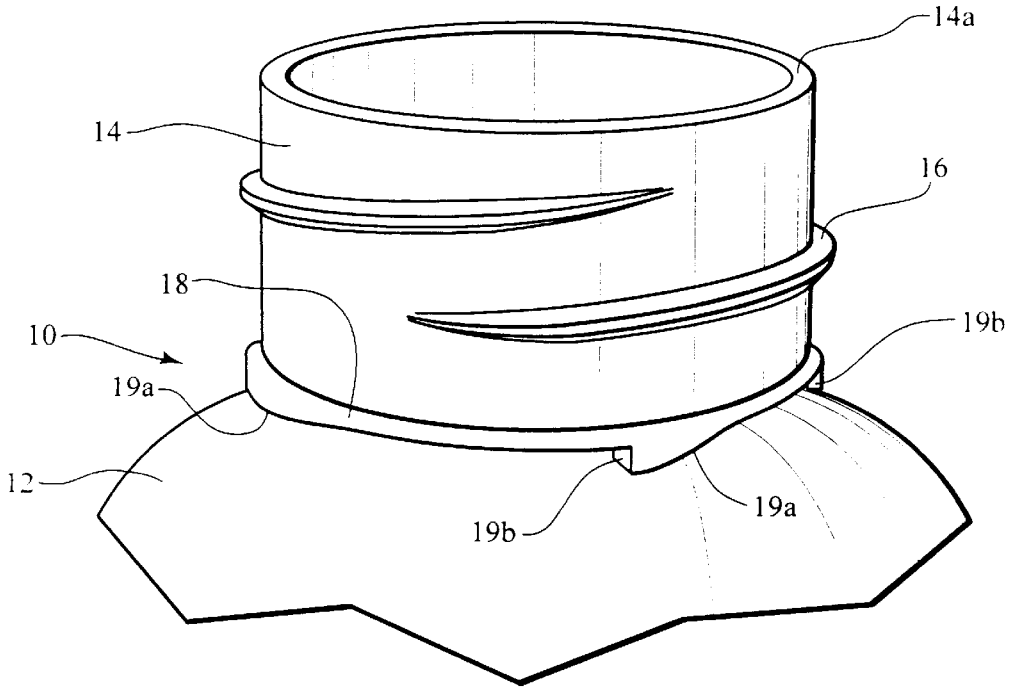

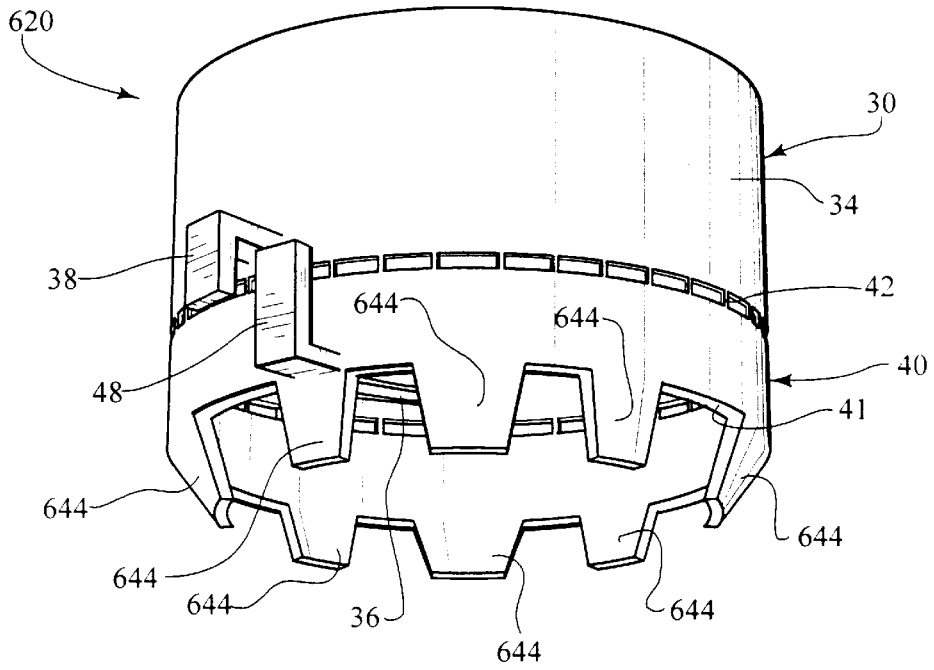
FIG. 17
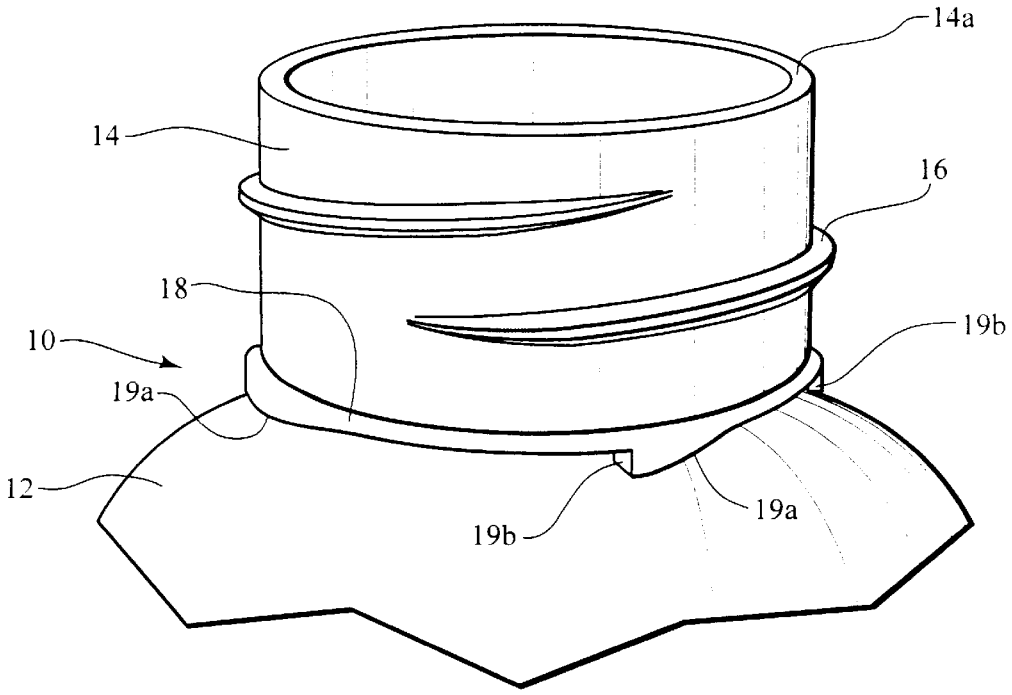

SAFETY CLOSURE HAVING TAMPER-INDICATING MEANS

BACKGROUND OF THE INVENTION

1. Technical Field of the Invention

The present invention relates to safety closures for use on containers. More particularly, the present invention relates to a safety closure for use on a container, wherein the safety closure includes a tamper-indicating band having child-resistant features.

2. Description of the Related Art

It is often desirable to provide a safety closure for use on a container neck portion, wherein the safety closure includes tamper-indicating means integrally formed therewith and wherein the tamper-indicating means includes a removable, detachable or frangible portion thereof which must be removed, detached or otherwise broken prior to a first removal of the safety closure from the container neck portion. In the absence of an unbroken tamper-indicating means, an individual is thereby notified that the container has been previously opened. It is therefore desirable to provide a safety closure for use on a container neck portion, wherein the safety closure is provided with tamper-indicating means.

For example, U.S. Pat. No. 4,341,318 to Smalley teaches a closure with a child-resistant tamper-proof band frangibly attached thereto and removable therefrom. Removal of the closure from a container neck portion to which the closure has been snap-fit thereon requires prior removal of the tamper-proof band from the closure. Similarly, U.S. Pat. No. 4,573,599 to Fillmore teaches a closure having a tamper-indicating band which must be removed from the closure prior to removal of the closure from a container neck portion to which the closure has been snap-fit thereon. However, it is furthermore desirable to provide a safety closure threadingly fit upon a container neck portion, wherein the safety closure includes a tamper-indicating band frangibly attached thereto, and wherein the tamper-indicating band remains affixed to the container neck portion upon a first removal of the safety closure therefrom.

For example, U.S. Pat. No. 5,398,829 to Stubbs teaches a tamper-resistant, child-resistant cap assembly having a cap portion connected to a captive band by a tear-away portion. Upon removal of the tear-away portion, the cap can be removed from a container neck portion to which the cap has been snap-fit thereon, wherein the captive band remains affixed to the container neck portion. However, it is furthermore desirable to provide a safety closure threadingly fit upon a container neck portion, wherein the safety closure includes a tamper-indicating band frangibly attached thereto, wherein the tamper-indicating band remains affixed to the container neck portion upon a first removal of the safety closure therefrom, and wherein the tamper-indicating band includes locking means for engaging cooperating locking means provided on the safety closure.

SUMMARY OF THE INVENTION

The present invention is for a safety closure provided for threadingly engaging a neck portion of a container. The safety closure includes a cap portion and a tamper-indicating band connected to a lower end of a peripheral side wall of the cap portion by a plurality of frangible bridge segments. A cap lug depends downwardly from an outer surface of the cap portion and is sized to engage a band lug projecting upwardly from an outer surface of the tamper-indicating band. At least one arcuate bead segment projects inwardly from an inner surface of the tamper-indicating band and is sized to engage a continuous bead projecting outwardly from an outer surface of the container neck portion to prevent removal of the tamper-indicating band therefrom upon a first application thereto. Removal of the cap portion from the container neck portion a first time breaks the plurality of frangible bridge segments, thereby detaching the cap portion from the tamper-indicating band and permitting removal of the cap portion from the container neck portion, while retaining the tamper-indicating band on the container neck portion for subsequent use.

It is an object of the present invention to provide a safety closure for use on a container neck portion, wherein the safety closure is provided with tamper-indicating means.

It is another object of the present invention to provide a safety closure threadingly fit upon a container neck portion, wherein the safety closure includes a tamper-indicating band frangibly attached thereto, and wherein the tamper-indicating band remains affixed to the container neck portion upon a first removal of the safety closure therefrom.

It is yet another object of the present invention to provide a safety closure threadingly fit upon a container neck portion, wherein the safety closure includes a tamper-indicating band frangibly attached thereto, wherein the tamper-indicating band remains affixed to the container neck portion upon a first removal of the safety closure therefrom, and wherein the tamper-indicating band includes locking means for engaging cooperating locking means provided on the safety closure.

A safety closure according to a preferred embodiment of the present invention includes a cap portion having an end wall and a peripheral side wall depending downwardly from the end wall, the peripheral side wall having an internal thread projecting inwardly from an inner surface thereof; a tamper-indicating band connected to a lower end of the cap portion peripheral side wall by a plurality of frangible bridge segments, the tamper-indicating band having at least one bead segment projecting inwardly from an inner surface thereof, the tamper-indicating band being detachable from the cap portion; a cap lug projecting outwardly from an outer surface of the peripheral side wall near the lower end thereof; and, a band lug projecting upwardly from an outer surface of the tamper-indicating band, the band lug being engageable with the cap lug to prevent rotation of the cap portion relative to the tamper-indicating band.

BRIEF DESCRIPTION OF THE DRAWINGS

A better understanding of the present invention will be had upon reference to the following description in conjunction with the accompanying drawings in which like numerals refer to like parts, and wherein:

FIG. 1 is a perspective view of a safety closure according to a preferred embodiment of the present invention, shown in spaced relation to a container neck portion;

FIG. 6 is a perspective view of the tamper-indicating band portion of the safety closure of FIG. 5, shown fit upon the container neck portion of FIG. 5, wherein the cap portion of the safety closure is shown having been removed therefrom and in spaced relation thereto;

FIG. 7 is a perspective view of a safety closure according to an alternative embodiment of the present invention, shown in spaced relation to a container neck portion;

FIG. 8 is a perspective view of a safety closure according to another alternative embodiment of the present invention, shown in spaced relation to a container neck portion;

FIG. 13 is a perspective view of a safety closure according to another alternative embodiment of the present invention;

FIG. 14 is a perspective view of a safety closure according to another alternative embodiment of the present invention shown in spaced relation to the container neck portion of FIG. 1;

DETAILED DESCRIPTION OF THE PREFERRED EMBODIMENTS

Figure 2:
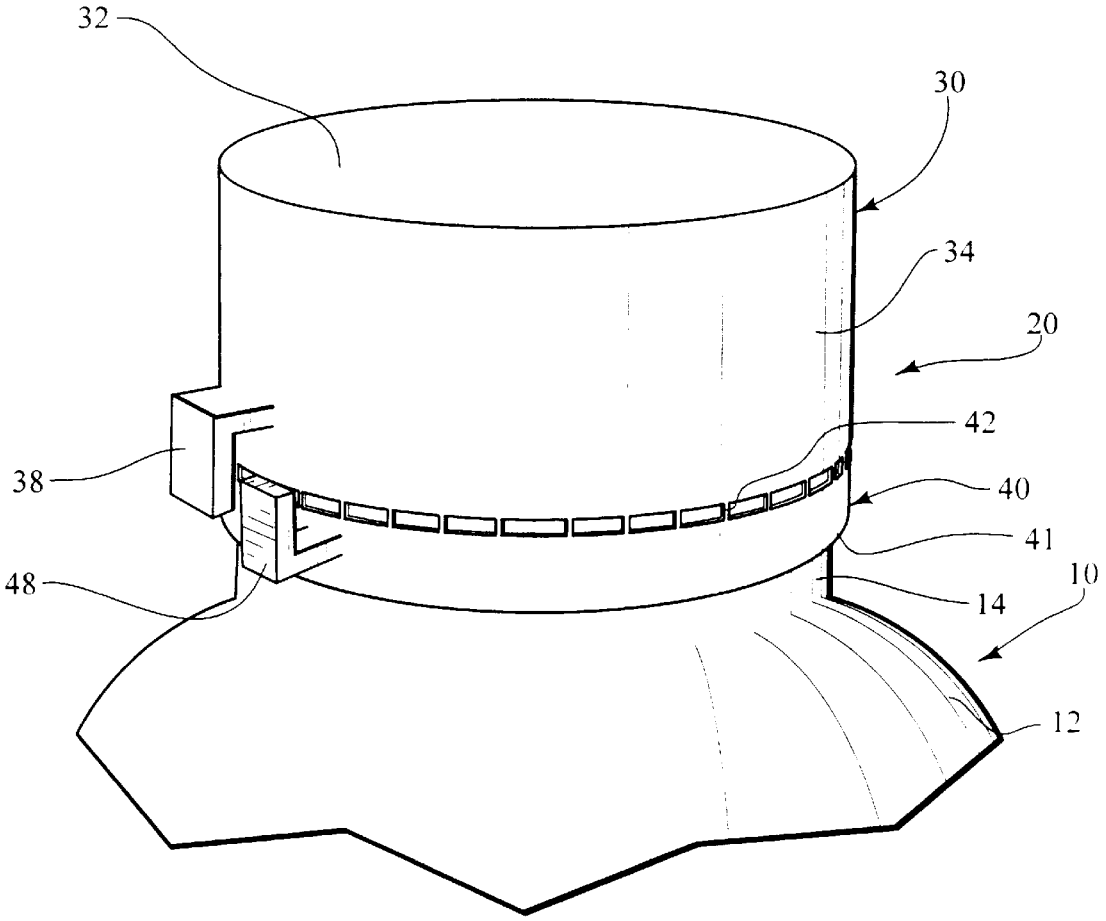
FIG. 2 is a perspective view of the safety closure of FIG. 1, shown threadingly fit upon the container neck portion of FIG. 1.

With reference to FIG. 1, a safety closure 20 according to a preferred embodiment of the present invention is provided for threading engagement with a container 10, such as, for example, a pill bottle, beverage dispenser or the like, having a body 12 and a neck portion 14 projecting upwardly from the body 12. The neck portion 14 includes an open upper end 14*a* which communicates with a cavity 13 (FIG. 3) defined within the body 12 to permit filling and dispensing of the container 10 therethrough. The safety closure 20 and the container 10 are each preferably constructed from an injection-molded thermal-setting polymer, such as, for example, high-density polyethylene or polypropylene. However, any suitable material which provides substantially similar functional properties as herein described may be substituted in place thereof without departing from either the spirit or the scope of the present invention.

The container neck portion 14 includes an external thread 16 projecting outwardly from an outer surface thereof and being sized to threadingly engage an internal thread 36 projecting inwardly from an inner surface of a cap portion 30 of the safety closure 20. A continuous container bead 18 projects outwardly from the outer surface of the container neck portion 14 between the external thread 16 and the container body 12. The container bead 18 includes at least one lug 19 integrally-molded therewith and depending downwardly therefrom towards the container body 12. More particularly, four lugs 19 are provided spaced equidistantly around the container bead 18, each lug including a downwardly-inclined surface 19*a* and an abutment 19*b* defined thereby.

The safety closure cap portion 30 includes an end wall 32 (FIG. 2) and a peripheral skirt 34 depending downwardly from an outer periphery thereof. A tamper-indicating band 40 is integrally-molded with a lower end of the peripheral skirt 34 and connected thereto by a plurality of frangible bridge segments 42. A plurality of arcuate bead segments 44 project inwardly from an inner surface of the tamper-indicating band 40, defining at least one arcuate recess 45 therebetween. More particularly, the plurality of arcuate bead segments 44 are sized and spaced around the inner surface of the tamper-indicating band 40 such that, upon threadingly fitting the safety closure 20 onto the container neck portion 14 as hereinbelow described and as shown typically in FIG. 2, each of the at least one container bead lugs 19 is received within one of the at least one arcuate recesses 45 and, likewise, under the container bead 18, thereby preventing removal of the tamper-indicating band 40 from the container neck portion 14 without causing noticeable damage thereto.

The tamper-indicating band 40 is permitted to rotate relative to the container neck portion 14 in a first direction, such as, for example, in a direction corresponding to threading engagement of the safety closure 20 onto the container neck portion 14, due to the downwardly-inclined surfaces 19*a* of the lugs 19. The tamper-indicating band 40 is permitted to rotate freely in the first direction until the arcuate bead segments 44 abut the downwardly-inclined surfaces 19*a* of the lugs 19, at which point additional rotation in the first direction causes the arcuate bead segments 44 to pass downwardly along the downwardly-inclined surfaces 19*a* and snap upwardly behind the abutments 19*b*. However, rotation in a second direction, such as, for example, in a direction opposite to the first direction, that is, in a direction corresponding to the unthreading of the safety closure 20 from the container neck portion 14, is prevented by the abutments 19*b*, over which the arcuate bead segments 44 cannot pass.

A cap lug 38 is integrally-molded with and projects outwardly and downwardly from an outer surface of the safety closure cap portion 30 near the tamper-indicating band 40. The cap lug 38 includes an inverted "L" shape having a sufficient width and a depth to prevent flexure thereof in either the radial direction, that is, a direction directed towards the peripheral skirt 34, or the tangential direction, that is, a direction perpendicular to the radial direction. A band lug 48 is integrally-molded with and projects outwardly and upwardly from an outer surface of the tamper-indicating band 40 near a lower end 41 thereof. The band lug 48 includes an upright "L" shape having a sufficient width to prevent flexure thereof in the tangential direction, and having a sufficient depth to permit resilient radial flexure thereof towards the cap portion peripheral skirt 34. The cap lug 38 and the band lug 48 are sized, shaped and positioned to abut one another when the cap portion 30 is rotated relative to the tamper-indicating band 40 (FIG. 4) and to prevent further rotation of the cap portion 30 relative to the tamper-indicating band 40 without first moving either the band lug 48 to overcome the cap lug 38, or the cap lug 38 to overcome the band lug 48.

Figure 3:
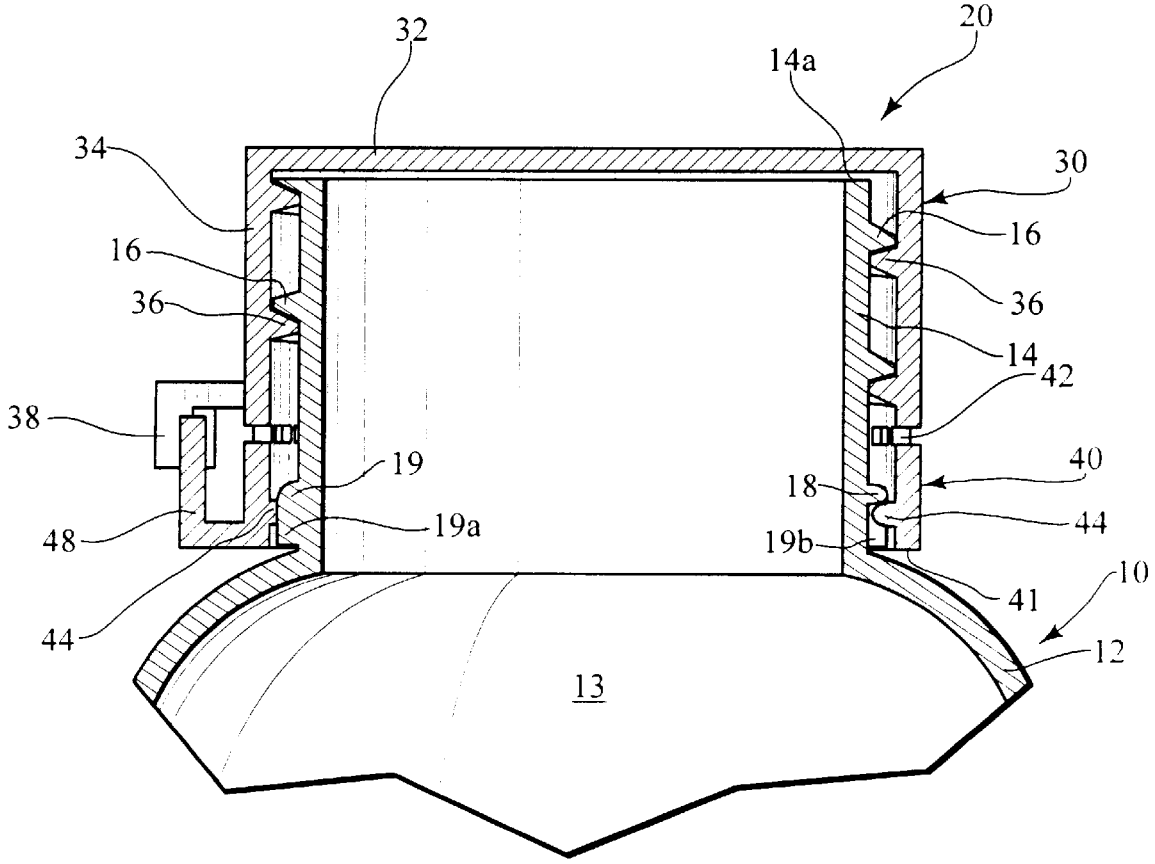
FIG. 3 is a section view of the safety closure of FIG. 2, shown threadingly fit upon the container neck portion of FIG. 2, and shown along section line 3—3 of FIG. 2.

With additional reference to FIGS. 2 and 3, the safety closure 20 is threadingly fit upon the container neck portion 14 by engagement of the threads 16, 36 and by downward rotation of the safety closure 20 relative to the container neck portion 14 in the first direction, thereby causing the safety closure 20 to move axially downwardly onto the container neck portion 14 until the tamper-indicating band arcuate bead segments 44 abut the container bead 18. Additional rotation of the safety closure 20 causes the tamper-indicating band 40, and likewise, the cap portion peripheral skirt 34, to deflect radially outwardly as the bead segments 44 pass over and below the container bead 18 and seat tightly between the container bead lugs 19 and within one of the at least one arcuate recesses 45.

Figure 4:
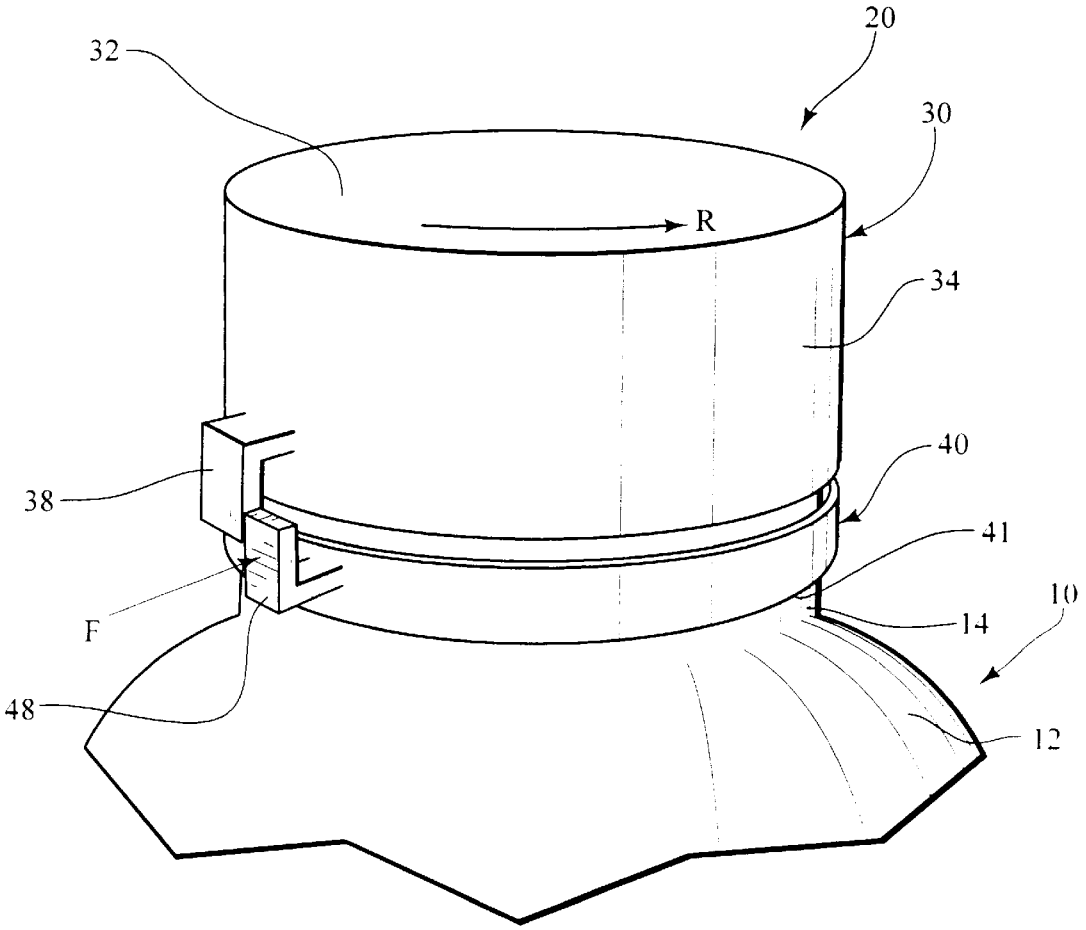
FIG. 4 is a perspective view of the safety closure of FIG. 1, shown threadingly fit upon the container neck portion of FIG. 1, wherein a cap portion of the safety closure is shown detached from a tamper-indicating band portion of the safety closure.
Figure 5:
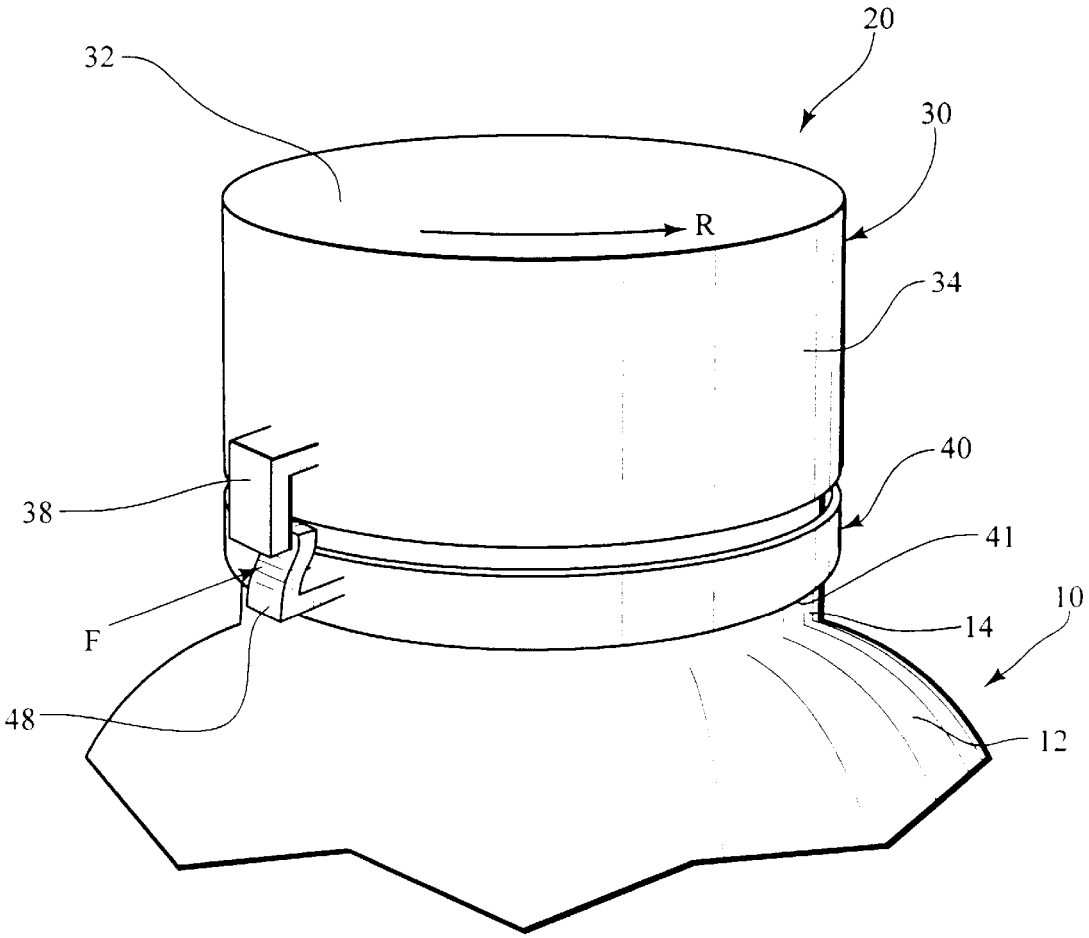
FIG. 5 is a perspective view of the safety closure of FIG. 4, shown threadingly fit upon the container neck portion of FIG. 4, wherein a locking lug of the tamper-indicating band portion of the safety closure is shown deformed inwardly so that a locking lug of the cap portion of the safety closure may pass radially outwardly with respect thereto.
Figure 9:
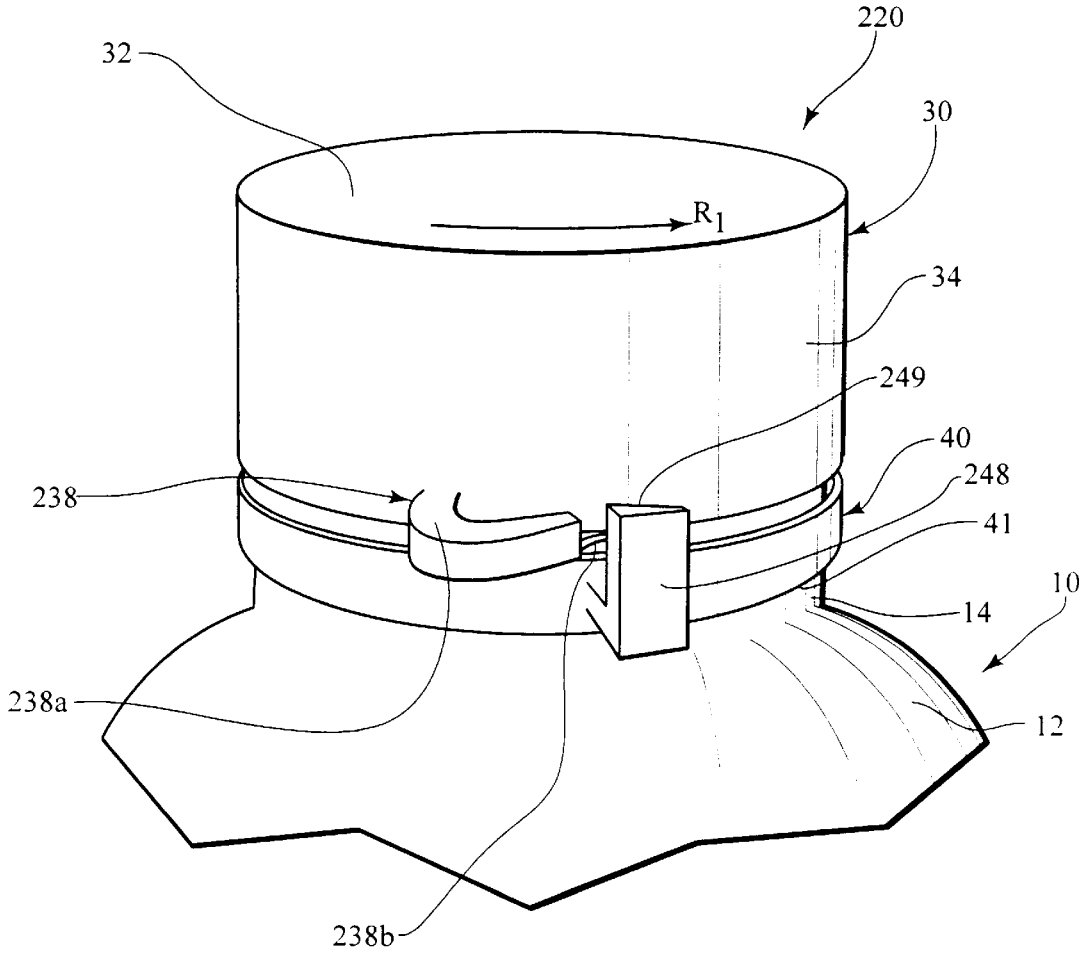
FIG. 9 is a perspective view of the safety closure of FIG. 8, shown threadingly fit upon the container neck portion of FIG. 8, wherein a cap portion of the safety closure is shown detached from a tamper-indicating band portion of the safety closure.
Figure 10:
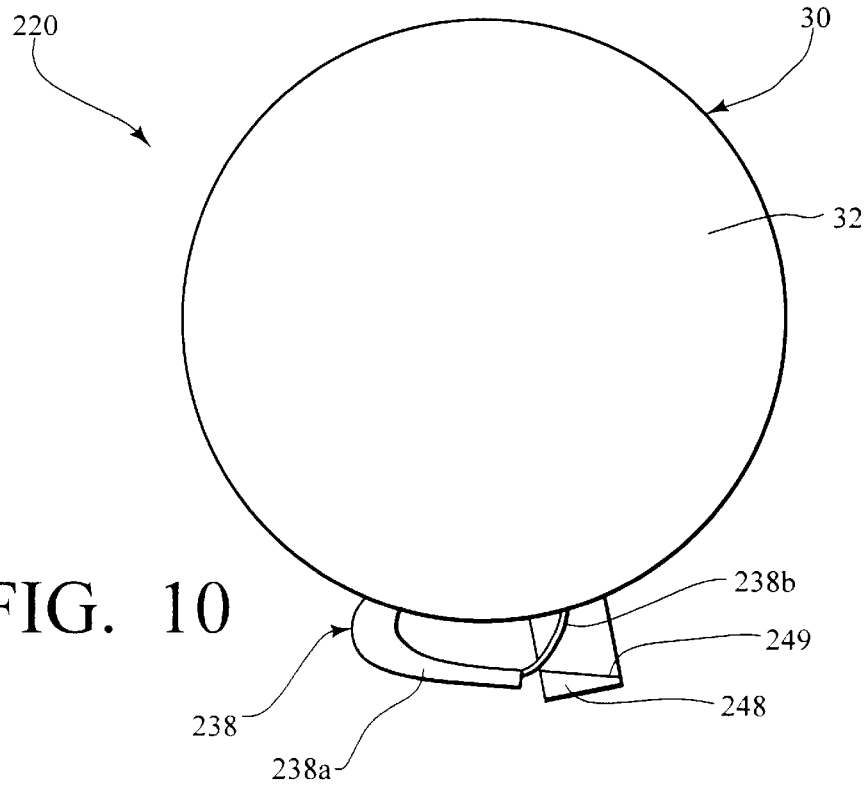
FIG. 10 is a top view of the safety closure of FIG. 8, showing a locking lug of the cap portion of the safety closure in an undeformed position to abut a locking lug of the tamper-indicating band portion of the safety closure.
Figure 11:
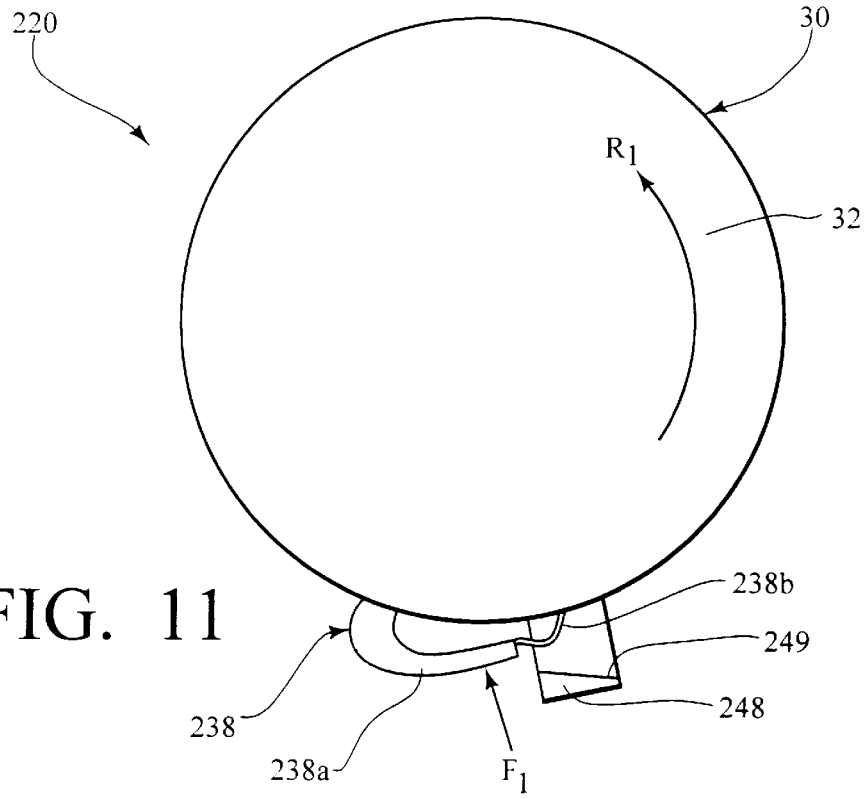
FIG. 11 is a top view of the safety closure of FIG. 10, showing the locking lug of the cap portion of the safety closure being deformed inwardly to permit the locking lug of the tamper-indicating band to pass outwardly thereover.

With additional reference to FIGS. 4–6, the cap lug 38 and the band lug 48 are integrally-molded with the cap portion 30 and the tamper-indicating band 40, respectively, and positioned with respect thereto such that the cap portion 30 may be rotated relative to the tamper-indicating band 40 (which is prevented from rotating in the second direction relative to the container neck portion 14 by the engagement of the arcuate bead segments 44 with the container bead abutments 19*b*) a sufficient angular distance to break the frangible bridge segments 42 before the cap lug 38 is rotated into abutting relation with the band lug 48, thereby permitting detachment of the tamper-indicating band 40 from the cap portion 30 and permitting removal of the cap portion 30 from the container neck portion 14 independently from the tamper-indicating band 40. Removal rotation of the cap portion 30 relative to either the container neck portion 14 or the tamper-indicating band 40 in the second direction is ordinarily prevented by the abutting lugs 38, 48, which prevent removal rotation of the cap portion 30 relative to the tamper-indicating band 40, and by the bead segments 44 engaging the lug abutments 19*b* of the container bead 18, which prevent removal rotation of the tamper-indicating band 40 relative to the container neck portion 14. Thus, the cap portion 30 cannot be removed from the container neck portion 14 without first causing the cap lug 38 to overcome the abutting relation of the band lug 48.

The cap portion 30 may nevertheless be removed from the container neck portion 14, thereby permitting access to the contents of the container 10, by applying with one hand an inwardly-directed flexure force, generally indicated in the Figures as reference letter "F", to the band lug 48, thereby causing an upstanding portion of the band lug 48 to flex radially inwardly towards the safety closure 20. Once the upstanding portion of the band lug 48 is flexed radially inwardly a sufficient distance to permit the cap lug 38 to pass radially outwardly thereof, a twisting force, generally indicated in the Figures as reference letter "R", is applied by another hand to the cap portion 30, causing the cap portion 30 to be threadingly removed from the container neck portion 14. Flexure force "F" is then removed, whereby the upstanding portion of the band lug 48 is permitted to return to its original, unflexed, position.

The container bead lugs 19 are spaced around the container bead 18 such that rotation of the tamper-indicating band 40 in the second direction from the downwardly-inclined surface 19*a* of one lug 19 to the abutment 19*b* of an adjacent lug 19 does not correspond with a rotation of the cap portion 30 therewith a sufficient angular distance to permit the cap lug 38 to move axially upwardly a sufficiently distance to overcome the uppermost end of the upstanding portion of the band lug 48. Preferably, the container bead lugs 19 and the arcuate bead segments 44 of the tamper-indicating band 40 are sized, shaped and positioned to permit very little angular movement of the tamper-indicating band 40 in the second direction, thereby reducing the likelihood that the cap portion 30 may be unthreaded off of the container neck portion 14 before the cap lug 38 abuts the band lug 48.

Fitting the safety closure 20 upon the container neck portion 14 a first time thereby seats the tamper-indicating band 40 under the container bead 18 and prevents removal of the tamper-indicating band 40 from the container neck portion without causing damage thereto. However, the tamper-indicating band 40 may be permanently removed from the container neck portion 14, whereafter the safety closure 20 lacks the aforementioned child-resistant features. Removal of the cap portion 30 from the tamper-indicating band 40 a first time breaks the frangible bridge segments 42, thereby indicating that the container 10 has been opened at least one time. Threading the cap portion 30 onto the container neck portion 14 subsequent and repeated times permits re-engagement of the cap lug 38 with the band lug 48, thereby providing child-resistant features thereto.

With reference to FIG. 7, a safety closure 120 according to an alternative embodiment of the present invention includes many components in common with the safety closure 20 according to the preferred embodiment hereinabove described and like reference numerals are intended to represent like components. However, with respect to the present embodiment, the band lug 148 includes an angled surface 149 to guide the band lug 148 under the cap lug 38 when the cap portion 30 is being threadingly affixed to the container neck portion 14 subsequent to a first removal therefrom. The angled surface 149 of the band lug 148 may either face outwardly from the cap portion peripheral skirt 34, such as is shown in FIG. 7, or may face inwardly towards the cap portion peripheral skirt 34, wherein the cap lug 38 would pass between the band lug 148 and the cap portion peripheral skirt 34 during threading and unthreading of the cap portion 30 from the container neck portion 14. Accordingly, the sizes, shapes and dimensions of the cap lug 38 and the band lug 148 may be varied to permit flexure of either the cap lug 38 or the band lug 148 relative to the other so as to function as hereinabove described.

The angled surface 149 of the band lug 148 must be sized and shaped such that the cap lug 38 may pass thereover without causing significant rotation of the tamper-indicating band 40 relative to the container neck portion 14.

With reference to FIGS. 8–11, a safety closure 220 according to another alternative embodiment of the present invention includes many components in common with the safety closure 20 according to the preferred embodiment herein hereinabove described and like reference numerals are intended to represent like components. However, with respect to the present embodiment, the cap lug 238 includes an arm portion 238*a* integrally-molded with and projecting outwardly and rearwardly from the outer surface of the peripheral skirt 34. An outermost end of the cap lug arm portion 238*a* is connected to the outer surface of the peripheral skirt 34 by an integrally-molded, resilient bridge member 239 to bias the arm portion 238*a* in an outwardly position, such as shown, for example, in FIG. 10.

The safety closure 220 according to the present embodiment is removed from the container neck portion 14, thereby permitting access to the contents of the container 10, by applying an inwardly-directed flexure force, generally indicated in the Figures as reference letter "$F_1$", to the arm portion 238*a* of the cap lug 238, thereby causing the outermost end of the arm portion 238*a* adjacent to the resilient bridge member 238*b* to flex radially inwardly towards the safety closure 20. Once the arm portion 248*a* is flexed radially inwardly a sufficient distance to permit the band lug 238 to pass radially outwardly thereof, a twisting force, generally indicated in the Figures as reference letter "$R_1$", is applied to the cap portion 30, causing the cap portion 30 to be threadingly removed from the container neck portion 14. Flexure force "$F_1$" is then removed, whereby the arm portion 238*a* of the cap lug 238 is permitted to return to its original, unflexed, position. The band lug 248 may include an angled surface 249 to guide the cap lug 238 under the band lug 248 when the cap portion 30 is being threadingly affixed to the container neck portion 14 subsequent to a first removal therefrom.

Figure 12:
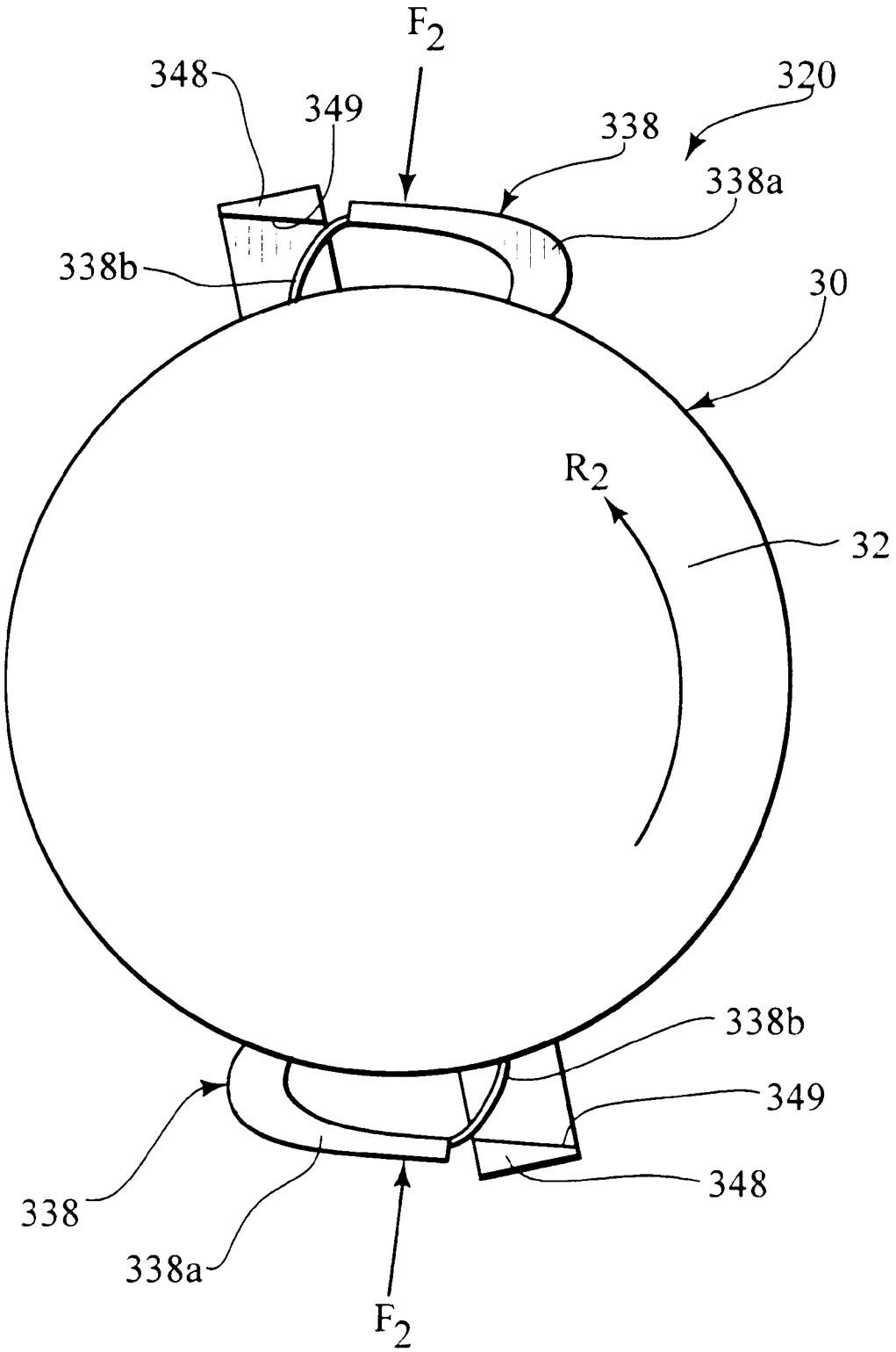
FIG. 12 is a top view of a safety closure according to another alternative embodiment of the present invention.

With reference to FIG. 12, a safety closure 320 according to another alternative embodiment of the present invention includes many components in common with the safety closure 20 according to the preferred embodiment hereinabove described and like reference numerals are intended to represent like components. However, with respect to the present embodiment, a pair of diametrically-opposed cap lugs 338 are provided, wherein each of the cap lugs 338 includes an arm portion 338*a* integrally-molded with and projecting outwardly and rearwardly from the outer surface of the peripheral skirt 34. An outermost end of the cap lug 338 is connected to the outer surface of the peripheral skirt 34 by an integrally-molded, resilient bridge member 339 to bias the arm portion 338*a* in an outwardly position, such as shown, for example in FIG. 12.

The safety closure 320 according to the present embodiment is removed from the container neck portion 14, thereby permitting access to the contents of the container 10, by applying an inwardly-directed opposing flexure forces, generally indicated in the Figures as reference letter "$F_2$", to each of the arm portions 338*a* of the cap lugs 338, thereby causing respective outermost ends of the arm portions 338*a* adjacent to the resilient bridge members 338*b* to flex radially inwardly towards the safety closure 20. Once the arm portions 348*a* are flexed radially inwardly a sufficient distance to permit the band lugs 338 to pass radially outwardly thereof, a twisting force, generally indicated in the Figures as reference letter "$R_2$", is applied to the cap portion 30, causing the cap portion 30 to be threadingly removed from the container neck portion 14. Flexure forces "$F_2$" are then removed, whereby the arm portions 338*a* of the cap lugs 338 are permitted to return to their original, unflexed, positions. The band lugs 348 may each include an angled surface 349 to guide the cap lugs 338 under the band lug 348 when the cap portion 30 is being threadingly affixed to the container neck portion 14 subsequent to a first removal therefrom.

With reference to FIG. 13, a safety closure 420 according to an alternative embodiment of the present invention includes many components in common with the safety closure 20 according to the preferred embodiment hereinabove described and like reference numerals are intended to represent like components. However, with respect to the present embodiment, the cap lug 438 includes an angled surface 439 to guide the cap lug 438 over the band lug 48 when the cap portion 30 is being threadingly affixed to the container neck portion 14 subsequent to a first removal therefrom.

Figure 15:
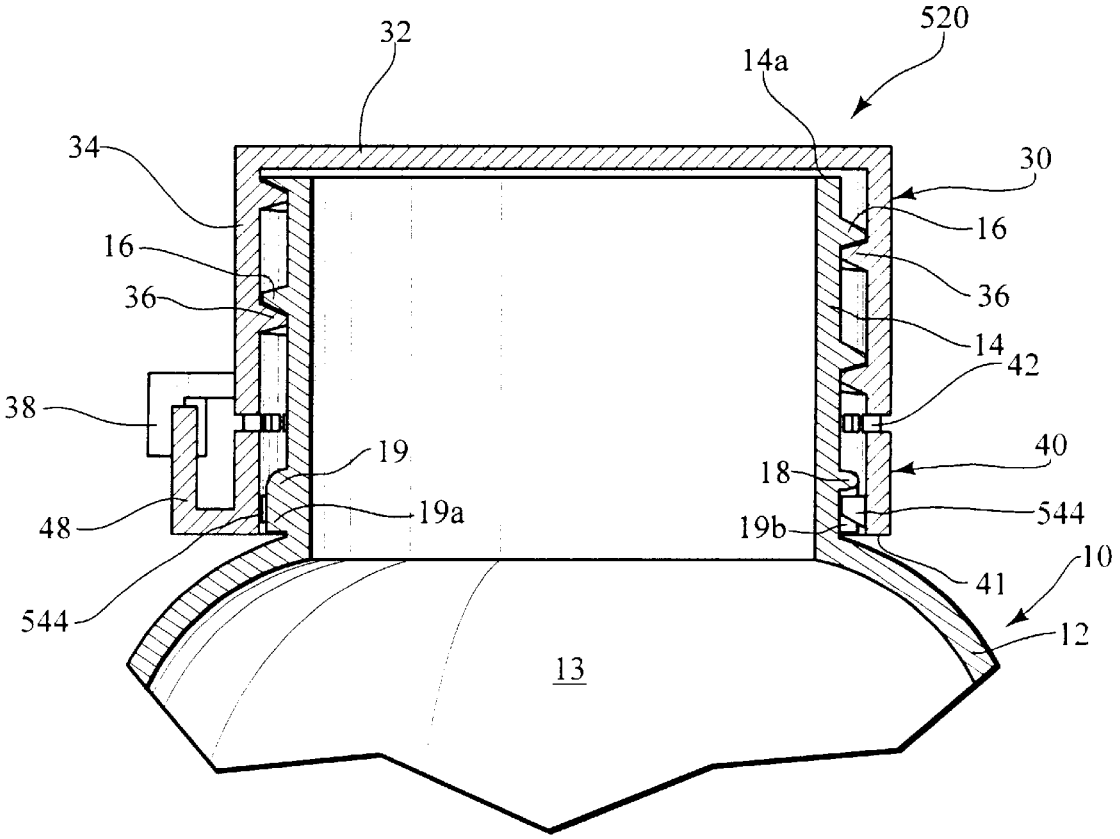
FIG. 15 is a section view of the safety closure of FIG. 14, shown along section line 15—15 of FIG. 14.
Figure 16:
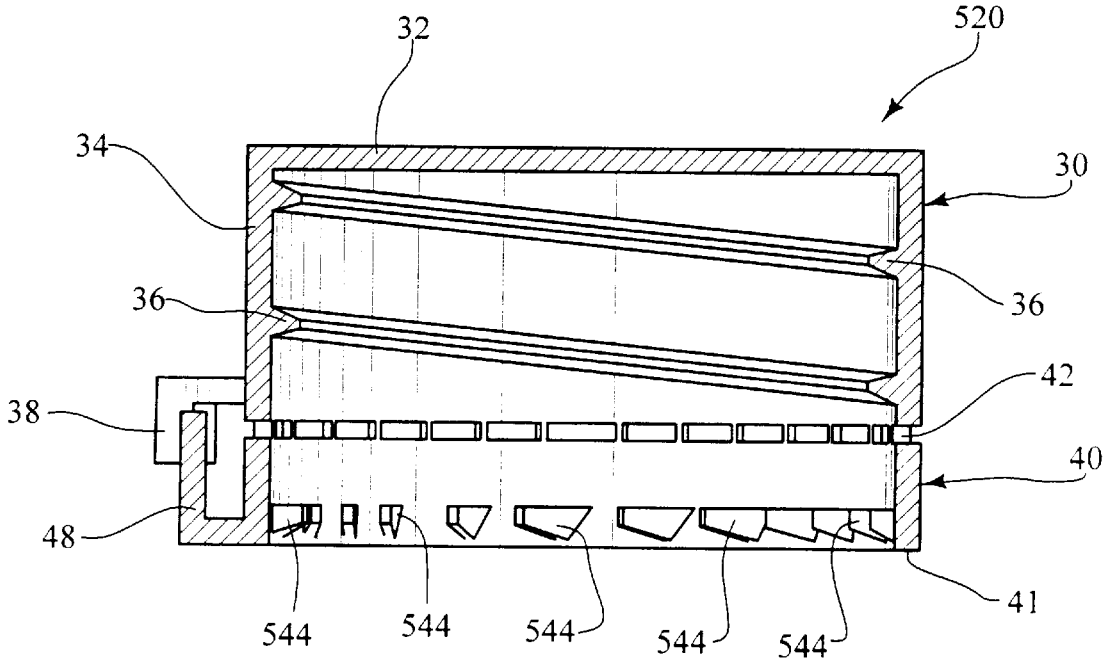
FIG. 16 is a section view of the safety closure of FIG. 14, shown threadingly fit upon the container neck portion of FIG. 14; and, FIG. 17 is a perspective view of a safety closure according to another embodiment of the present invention shown in spaced relation to the container neck portion of FIG. 1.

With reference to FIGS. 14–16, a safety closure 520 according to another alternative embodiment of the present invention includes many components in common with the safety closure 20 according to the preferred embodiment hereinabove described and like reference numerals are intended to represent like components. However, with respect to the present embodiment, the plurality of arcuate bead segments 44 (FIG. 1) provided on the safety closure 20 of the preferred embodiment hereof have been replaced with a plurality of circumferentially-spaced, flexible projections 544 sized to engage the underside of the container bead 18. Preferably, each of the plurality of flexible projections 544 is integrally molded with the inner surface of the tamper-indicating band 40 at a base edge thereof and projects inwardly therefrom at an angle thereto. Each projection 544 includes an inclined lower edge angled upwardly away from the inner surface of the tamper-indicating band 40. Further, each projection 544 is obliquely angled with respect to the central axis of the closure 540.

Upon threading the safety closure 540 to the container neck portion 14, the projections 544 are guided over the container bead 18 by the oblique angle thereof and flex towards the inner surface of the tamper-indicating band. Once the projections 544 pass axially below the container bead, the resilient projections 544 are seated under the container bead 18 and behind the abutments 19*b*, thereby preventing removal of the tamper-indicating band 40 from the container neck portion 14 without causing damage to either the projections 544, the tamper-indicating band 40 or the container neck portion 14.

Alternatively, the projections 544 may have any suitable shape, size or design with engages the abutments 19*b* of the container bead 18 to prevent removal therefrom.

With reference to FIG. 17, a safety closure 620 according to another embodiment of the present invention includes many components in common with the safety closure 20 according to the preferred embodiment hereof hereinabove described and like reference numerals are intended to represent like components. However, the safety closure 620 according to the present embodiment includes a plurality of circumferentially-spaced, downwardly-depending flexible projections 644 sized to engage the underside of the container bead 18. Preferably, each of the plurality of flexible projections 644 is integrally molded with the lower end 41 of the tamper-indicating band 40. Each projection 644 projects radially inwardly.

Upon threading the safety closure 640 to the container neck portion 14, the projections 644 abut an upper surface of the container bead 18 and pivot inwardly and upwardly about the lower end 41 of the tamper-indicating band 40. Once the projections 644 pass axially below the container bead 18, the resilient projections 644 are seated under the container bead 18 and behind the abutments 19*b*, thereby preventing removal of the tamper-indicating band 40 from the container neck portion 14 without causing damage to either the projections 644, the tamper-indicating band 40 or the container neck portion 14.

Alternatively, the projections 644 may have any suitable shape, size or design with engages the abutments 19*b* of the container bead 18 to prevent removal therefrom.

Although the present invention has been described in terms of specific embodiments which are set forth in detail, it should be understood that this is by illustration only and that the present invention is not necessarily limited thereto, since alternative embodiments not described in detail herein will become apparent to those skilled in the art in view of the disclosure. Accordingly, modifications are contemplated which can be made without departing from either the spirit or the scope of the present invention as described hereinabove.

I claim:

1. A safety closure, comprising:

a cap portion having an end wall and a peripheral side wall depending from said end wall;

a tamper-indicating band connected to said cap portion peripheral side wall by a plurality of frangible bridge segments, said tamper-indicating band having at least one bead segment projecting therefrom, said tamper-indicating band being detachable from said cap portion;

a cap lug projecting from said peripheral side wall near said lower end thereof; and, a band lug projecting from said tamper-indicating band, said band lug being engageable with said cap lug to prevent rotation of said cap portion relative to said tamper-indicating band upon detachment of said band from said cap portion.

2. The safety closure of claim 1, said band lug being resiliently deformable to disengage said cap lug.

3. The safety closure of claim 1, said band lug having an angled surface.

4. The safety closure of claim 1, said safety closure being integrally-formed.

5. The safety closure of claim 1, said cap lug having a downwardly-depending portion.

6. The safety closure of claim 1, said band lug having an upwardly-projecting portion.

7. The safety closure of claim 1, said cap lug having a resilient bridge integrally-formed with and connecting an end of said cap lug to said peripheral skirt.

8. The safety closure of claim 1, said cap lug being resiliently deformable to disengage said band lug.

9. The safety closure of claim 1, said cap lug having an angled surface.

10. The safety closure of claim 1, said cap portion peripheral side wall further including an internal thread projecting inwardly from an inner surface thereof.

11. A safety container assembly, comprising:

a container including a body portion defining a cavity therein, a neck portion having an open upper end communicating with said cavity, and at least one container bead segment projecting from said neck portion; and, a closure including a cap portion having an end wall and a peripheral side wall depending from said end wall, a tamper-indicating band connected to said cap portion peripheral side wall by a plurality of frangible bridge segments, said tamper-indicating band having at least one bead segment projecting therefrom, said at least one bead segment cooperating with said at least one container bead segment to prevent removal of said tamper-indicating band from said container neck portion, said tamper-indicating band being detachable from said cap portion, a cap lug projecting from said peripheral side wall near said lower end thereof, and, a band lug projecting from said tamper-indicating band, said band lug being engageable with said cap lug to prevent rotation of said cap portion relative to said tamper-indicating band upon detachment of said band from said cap portion.

12. The safety container assembly of claim 11, said band lug being resiliently deformable to disengage said cap lug.

13. The safety container assembly of claim 11, said band lug having an angled surface.

14. The safety container assembly of claim 11, said safety closure being integrally-formed.

15. The safety container assembly of claim 11, said cap lug having a downwardly-depending portion.

16. The safety container assembly of claim 11, said band lug having an upwardly-projecting portion.

17. The safety container assembly of claim 11, said cap lug having a resilient bridge integrally-formed with and connecting an outermost end of said cap lug to said peripheral skirt.

18. The safety container assembly of claim 11, said cap lug being resiliently deformable to disengage said band lug.

19. The safety container assembly of claim 11, said cap lug having an angled surface.

20. The safety container assembly of claim 11, wherein:

said container neck portion further includes an external thread projection outwardly from an outer surface thereof;

said closure cap portion further includes an internal thread projecting inwardly from an inner surface thereof; and, said internal thread being engageable with said external thread to threadingly affix said closure on said container neck portion.

21. The safety container assembly of claim 11, said at least one container bead segment including at least one lug portion, said at least one lug portion cooperating with said at least one bead segment of said closure tamper-indicating band to permit rotation of said closure relative to said container in a first direction thereof and to inhibit rotation of said closure relative to said container in a second direction thereof.

22. The safety container assembly of claim 21, said at least one lug portion having an inclined surface and an abutment.

23. A safety closure, comprising:

a cap portion having an end wall and a peripheral side wall depending from said end wall;

a tamper-indicating band connected to said cap portion peripheral side wall by a plurality of frangible bridge segments, said tamper-indicating band being detachable from said cap portion, said tamper-indicating band having means for retaining said tamper-indicating band on a neck portion of a container;

a cap lug projecting from said peripheral side wall near said lower end thereof; and, a band lug projecting from said tamper-indicating band, said band lug being engageable with said cap lug to prevent rotation of said cap portion relative to said tamper-indicating band upon detachment of said band from said cap portion.

24. The safety closure of claim 23, said means for retaining said tamper-indicating band on a neck portion of a container includes at least one bead segment projecting therefrom.

25. The safety closure of claim 23, said means for retaining said tamper-indicating band on a neck portion of a container includes at least one projection projecting inwardly therefrom.

26. The safety closure of claim 23, said band lug being resiliently deformable to disengage said cap lug.

27. The safety closure of claim 23, said band lug having an angled surface.

28. The safety closure of claim 23, said safety closure being integrally-formed.

29. The safety closure of claim 23, said cap lug having a downwardly-depending portion.

30. The safety closure of claim 23, said band lug having an upwardly-projecting portion.

31. The safety closure of claim 23, said cap lug having a resilient bridge integrally-formed with and connecting an end of said cap lug to said peripheral skirt.

32. The safety closure of claim 23, said cap lug being resiliently deformable to disengage said band lug.

33. The safety closure of claim 23, said cap lug having an angled surface.

34. The safety closure of claim 23, said cap portion peripheral side wall further including an internal thread projecting inwardly from an inner surface thereof.

* * * * *